US009353617B2

(12) United States Patent
Peterson

(10) Patent No.: US 9,353,617 B2
(45) Date of Patent: May 31, 2016

(54) APPARATUS AND METHOD OF REFERENCING A SUCKER ROD PUMP

(71) Applicant: Unico, Inc., Franksville, WI (US)

(72) Inventor: Ronald G. Peterson, Racine, WI (US)

(73) Assignee: Unico, Inc., Franksville, WI (US)

( * ) Notice: Subject to any disclaimer, the term of this patent is extended or adjusted under 35 U.S.C. 154(b) by 365 days.

(21) Appl. No.: 13/960,903

(22) Filed: Aug. 7, 2013

(65) Prior Publication Data

US 2014/0129037 A1 May 8, 2014

Related U.S. Application Data

(60) Provisional application No. 61/722,884, filed on Nov. 6, 2012.

(51) Int. Cl.

| | |
|---|---|
| ***E21B 43/12*** | (2006.01) |
| ***E21B 17/10*** | (2006.01) |
| ***G05B 13/02*** | (2006.01) |
| ***G05D 1/02*** | (2006.01) |
| ***G05D 1/10*** | (2006.01) |
| ***G05B 11/01*** | (2006.01) |
| ***G01P 3/00*** | (2006.01) |
| ***F04B 43/12*** | (2006.01) |
| ***F04B 49/00*** | (2006.01) |
| ***E21B 47/00*** | (2012.01) |
| ***F04B 47/02*** | (2006.01) |

(52) U.S. Cl.

CPC ..... *E21B 47/0008* (2013.01); *F04B 47/022* (2013.01)

(58) Field of Classification Search

CPC .... E21B 47/0008; E21B 44/04; F04B 47/022

USPC ..... 700/28, 71, 302; 166/250.15, 241.2; 702/145; 417/53

See application file for complete search history.

(56) References Cited

U.S. PATENT DOCUMENTS

| | | | | |
|---|---|---|---|---|
| 4,541,274 | A * | 9/1985 | Purcupile | E21B 47/0008 166/105 |
| 5,204,595 | A * | 4/1993 | Opal | F04B 47/022 318/430 |
| 6,343,656 | B1 | 2/2002 | Vazquez et al. | |
| 7,168,924 | B2 * | 1/2007 | Beck | E21B 43/126 417/1 |
| 8,240,221 | B2 * | 8/2012 | Simpson | F04B 47/02 166/105.2 |
| 8,444,393 | B2 * | 5/2013 | Beck | E21B 43/126 417/53 |
| 2004/0084179 | A1 * | 5/2004 | Watson | F04B 47/022 166/250.15 |

(Continued)

*Primary Examiner* — Ronald Hartman, Jr.

(74) *Attorney, Agent, or Firm* — Reinhart Boerner Van Deuren P.C.

(57) ABSTRACT

There is provided a method and system to determine the position of a sucker rod pumping system without a position sensing device during production pumping. A pump control system of the sucker rod pumping system includes a controller coupled to a database, with the controller configured to access an rxless torque value in the database. With the stored rxless torque value representative of toggle points of the crank arm during an initial calibration pumping cycle, the controller further is configured to continuously sample the rxless torque value of the system and determine the crank arm position in relation to the sample rxless torque value. The controller adjusts the pumping system for optimal operations, without a crank arm position sensor during production pumping by identifying a toggle point and setting the crank arm position estimate equal to the value corresponding to the crank position at the identified toggle point.

10 Claims, 8 Drawing Sheets

(56) References Cited

U.S. PATENT DOCUMENTS

2006/0067834 A1 3/2006 Boyer et al.
2006/0251525 A1* 11/2006 Beck ..... E21B 43/126 417/53
2008/0240930 A1* 10/2008 Palka ..... E21B 43/127 417/42
2009/0232662 A1* 9/2009 Mills ..... E21B 47/0008 417/1
2012/0205119 A1* 8/2012 Wentworth ..... F04B 49/06 166/369
2013/0127390 A1* 5/2013 DaCunha ..... H02P 5/74 318/490
2014/0014318 A1* 1/2014 Mail ..... B66B 9/04 166/77.4
2014/0088875 A1* 3/2014 Krauss ..... E21B 43/127 702/6

* cited by examiner $$\phi_3 = \tan^{-1}\left[\frac{R_1 \sin(\phi_1 - \phi_6)}{R_6 - R_1 \cos(\phi_1 - \phi_6)}\right] + \tan^{-1}\left\{\frac{R_5 \sin\left[\cos^{-1}\left(\frac{2R_1R_6\cos(\phi_1-\phi_6)+R_5^2+R_3^2-R_1^2-R_6^2}{2R_5R_3}\right)\right]}{R_3 - R_5\left(\frac{2R_1R_6\cos(\phi_1-\phi_6)+R_5^2+R_3^2-R_1^2-R_6^2}{2R_5R_3}\right)}\right\} - \phi_6$$

APPARATUS AND METHOD OF REFERENCING A SUCKER ROD PUMP

CROSS-REFERENCE TO RELATED PATENT APPLICATIONS

This application is a non-provisional application claiming priority to Provisional Application Ser. No. 61/722,884 filed Nov. 6, 2012, which is incorporated herein, in its entirely, by this reference.

FIELD OF THE INVENTION

The present disclosure relates generally to control of sucker rod pumps for oil, gas, and water wells, and move particularly to an apparatus and methods to determine position of a sucker rod pumping system without a position sensing device during production pumping for optimizing the operation of the rod pump.

BACKGROUND OF THE INVENTION

A sucker rod pumping unit reciprocates a rod string to actuate a subterranean pump for the purpose of lifting liquids to the surface. An exemplary embodiment is shown in FIG. 1. Such units are often instrumented with various sensors affixed to the pumping unit for the purpose of tracking pump and well performance. Historically, this instrumentation included sensors such as (but not limited to) rod load cell, crank position sensor, motor position sensor, motor current/voltage sensors, and beam inclinometer.

In addition to tracking system performance, these sensors can also be used to improve or optimize the pumping system operation, maximize production rates, and/or protect pumping equipment. For example, feedback information from sensors allows for the generation of "dynamometer plots" (pump load versus position data) which can be used to infer valuable down-hole conditions such as pump load, pump flow rate, well inflow, and pump health, which can in turn be used to improve or optimize the pumping system operation.

Sensors externally affixed to a pumping unit add additional cost, represent a potential failure mode, require frequent maintenance, and are often not functional owing to poor maintenance or neglect. Failure of these devices, especially in remotely located areas, can cause the pumping system to operate to sub-optimally, possibly hindering production rates and/or causing damage to the pumping system.

U.S. Pat. No. 7,168,924 describes a method whereby the rod load cell sensor may be eliminated, thus providing a less expensive and more reliable system. The '924 patent is assigned to the assignee of this application and is incorporated herein, in full, as if fully set-forth herein. However, a positioning sensor of some kind is still required for referencing of the absolute position of the pumping unit. This could include a crank position sensor (a discretely activated sensor or switch affixed to the pumping unit crank arm), an inclinometer affixed to the pumping unit main beam (Also referred to as a walking beam), or any other such method of determining crank position with an externally mounted "reference" device.

The apparatus of the present disclosure must also be of construction which is both durable and long lasting, and it should also require little or no maintenance to be provided by the user throughout its operating lifetime. In order to enhance the market appeal of the apparatus of the present disclosure, it should also be of inexpensive construction to thereby afford it the broadest possible market. Finally, it is also an objective that all of the aforesaid advantages and objectives be achieved without incurring any substantial relative disadvantage.

SUMMARY OF THE INVENTION

The disadvantages and limitations of the background art discussed above are overcome by the present disclosure.

There is provided a method and system to determine the position of a sucker rod pumping system without a position sensing device during production pumping. The pumping system includes a rod string carrying a downhole pump, a variable drive coupled to the rod string for reciprocation of the rod string within a wellbore and operating the pump. A crank arm, with a counter weight, is coupled to a main beam with a pitman arm and motor. The motor is coupled to a controller.

The method includes performing an initial commissioning procedure to determine an rxless torque value at toggle points of the crank arm during an initial calibration pumping cycle. The rxless torque value is measured and stored in a database coupled to the controller. During normal production pumping operation the controller continuously samples the rxless torque and determines the crank arm position in relation to the sample rxless torque value. The controller compares the sample rxless torque value to the stored rxless torque value and determines two of the sampled rxless torque values that correspond to the stored rxless torque values by the crank arm toggle points.

The controller adjusts the pumping system for optimal operation of the pumping system without a crank arm position sensor during production pumping by identifying a toggle point and setting the crank arm position estimate equal to the value corresponding to the crank position at that toggle point.

In one embodiment, the method includes defining a toggle point as one of a top dead center and bottom dead center position of the main beam when the rod string is at, respectively, a maximum and minimum extended position. In another embodiment, the method includes determining the rxless torque derivative and storing the derivative in the database. Each toggle point has an rxless torque derivative associated with it.

There is further provided a pump control system for controlling the performance of a sucker rod pump system during production pumping of a well. The sucker rod pumping system includes a rod string carrying a downhole pump, a variable drive coupled to the rod string for reciprocation of the rod string within a wellbore and operating the pump. A crank arm, with a counter weight, is coupled to a main beam with a pitman arm.

A pump control system of the sucker rod pumping system includes a controller coupled to a database, with the controller configured to access an rxless torque value in the database. With the stored rxless torque value representative of toggle points of the crank arm during an initial calibration pumping cycle, the controller further is configured to continuously sample the rxless torque value of the system and determine the crank arm position in relation to the sample rxless torque value. The system also includes a motor coupled to the pitman arm and the crank arm, with the performance of the motor controlled by the controller based on a comparison, by the controller, of the sampled rxless torque value to the stored rxless torque value. An identification is made of two of the sampled rxless torque values that correspond to the stored rxless torque values spaced by the crank arm toggle points. The controller then adjusts the motor, speed or torque by the controller to set the crank arm position to a toggle point for optimal operation of the pumping system without a crank arm position sensor during production pumping. In another embodiment, the pump control system includes configuring the controller to define a toggle point as one of a top dead center and bottom dead center position of the main beam when the rod string is at, respectively, a maximum and minimum extended position. In a further embodiment, the pump control system is configured such that the relationship between the crank arm counter weight and the pitman arm pivot is asymmetric.

The apparatus of the present invention is of a construction which is both durable and long lasting, and which will require little or no maintenance to be provided by the user throughout its operating lifetime. Finally, all of the aforesaid advantages and objectives are achieved without incurring any substantial relative disadvantage.

DESCRIPTION OF THE DRAWINGS

These and other advantages of the present disclosure are best understood with reference to the drawings, in which.

DETAILED DESCRIPTION OF THE EXEMPLARY EMBODIMENTS

Sucker rod pumping units are typically driven by an electric motor as the prime mover. In accord with the present disclosure a user is able to determine the crank position of the pumping unit (and therefore the absolute position reference) directly from the prime-mover motor torque and speed (derived from motor current and voltage). Once the absolute position of the crank and main beam are determined, the position of the sucker rod may be subsequently determined using information about the specific pump unit (as described below), where rod position is proportional to the main beam angle times the total rod stroke.

The preferred embodiment uses a system identification routine during initial calibration (also referred to as commissioning) for identifying the rotary inertia of the system, comprising the crank arm, gearbox, sheaves, and prime-mover motor armature. This routine is initially executed during pump commissioning with an inclinometer (or some other absolute positioning device) temporarily affixed to the pumping unit. Such commission of the system is done in a calibration pump cycle. The initial calibration procedure identifies and characterizes parameters of the system. During this routine, the pumping unit rotary inertia is characterized, and a normalized upstroke and down-stroke mechanism "toggle point" torques levels are stored, as described below. Alternatively, the rotary inertia could be preset or calculated by some means other than the system identification routine. The inclinometer device is subsequently removed and the system is operated in a production pump cycle without sensors on the pump structure or downhole in the wellbore.

Figure 1:
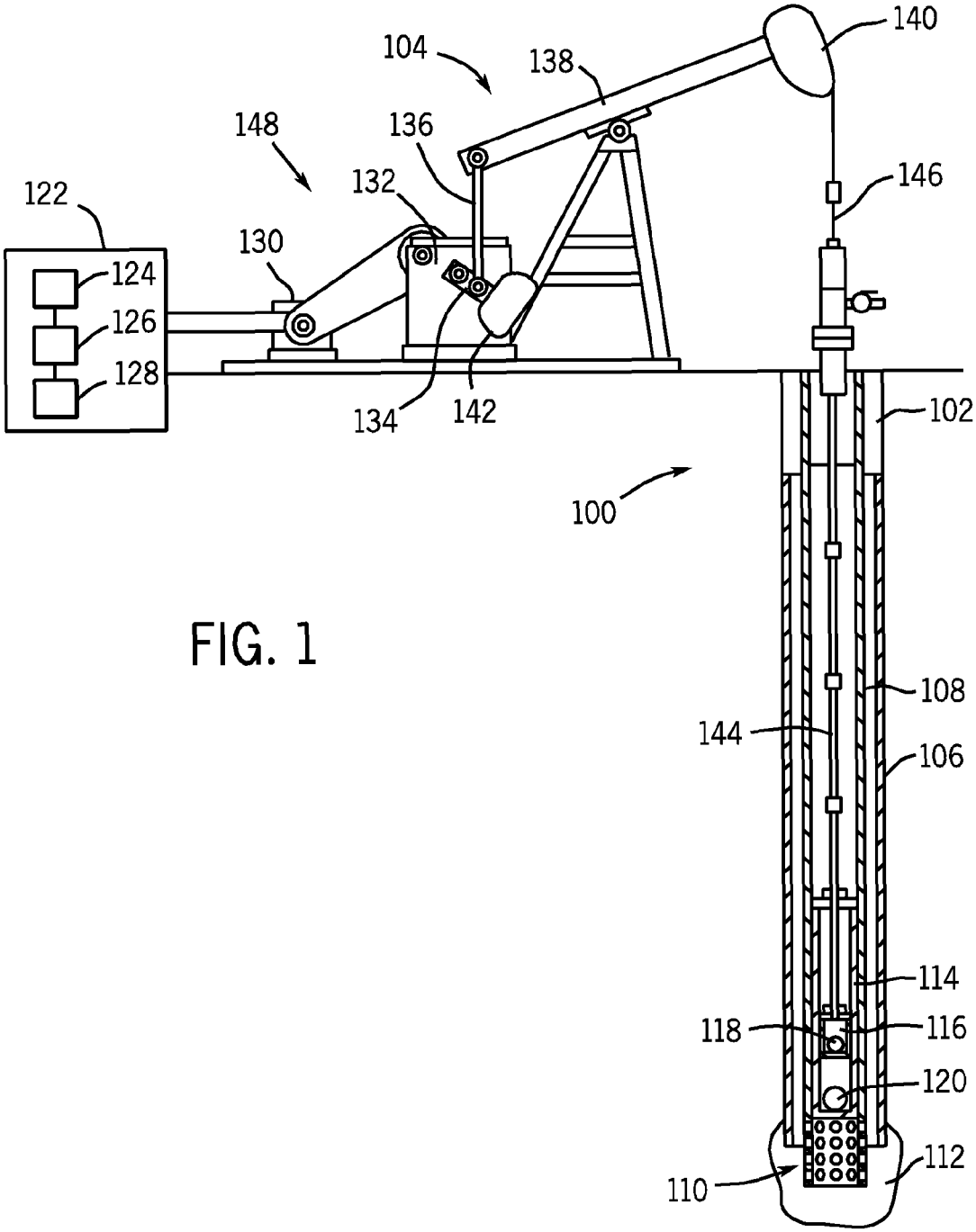
FIG. 1 is a representation of a sucker rod pump system including a controller, computer, and database configured to perform the disclosed method to optimize operation of the pump system for production pumping without a crank arm position.

Referring to FIG. 1, there is shown a sucker rod pump system 104, the operation of which is controlled by a rod pump control system and method including a parameter estimator in accordance with the present invention. For purposes of illustration, the rod pump control system 122 is described with reference to an application in a rod pump system 104 that includes a conventional beam pump. The beam pump has a walking beam 138 that reciprocates a rod string 144 that includes a polished rod portion 146. The rod string 144 is suspended from the beam for actuating a downhole pump 110 that is disposed at the bottom of a well 112. However, the rod pump control system and method provided by the invention are applicable to any system that uses an electric motor to reciprocate a rod string, including those that drive the rod through belt or chain drives. For example, a belt driven pumping unit includes a belt that is coupled to a rod string for reciprocating the rod string vertically within a well as the belt is driven by a motor.

The walking beam 138, in turn, is actuated by the pitman arm 31 which is reciprocated by a crank arm 134 driven by an electric motor 130 that is coupled to the crank arm 134 through a gear reduction mechanism, such as gearbox 132. The typical motor 130 can be a three-phase AC induction motor operable at 460 VAC and developing 10 125 horsepower, depending upon the capacity and depth of the pump. Other types of motors such as synchronous motors can be used to drive the pumping unit. The gearbox 132 converts motor torque to a low speed but high torque output for driving the crank arm 134. The crank arm 134 is provided with a counterweight 142 that serves to balance the rod string 144 suspended from the beam 138 in the manner known in the art. Counterbalance can also be provided by an air cylinder such as those found on air-balanced units. Belted pumping units may use a counterweight that runs in the opposite direction of the rod stroke.

The downhole pump 110 is a reciprocating type pump having a plunger 116 attached to the end of the rod string 144 and a pump barrel 114 which is attached to the end of tubing in the well 100. The plunger 116 includes a traveling valve 118 and a standing valve 120 positioned at the bottom of the barrel 114. On the up stroke of the pump, the traveling valve 118 closes and lifts fluid, such as oil and/or water, above the plunger 116 to the top of the well and the standing valve 120 opens and allows additional fluid from the reservoir to flow into the pump barrel 114. On the down stroke, the traveling valve 118 opens and the standing valve 120 closes in preparation of the next cycle. The operation of the pump 100 is controlled so that the fluid level maintained in the pump barrel 114 is sufficient to maintain the lower end of the rod string 144 in the fluid over its entire stroke.

In one embodiment, instantaneous motor currents and voltages together with pump parameters are used in determining rod position and load without the need for strain gauges, load cells, or position sensors as well as determining pump pressure and pump flow without the need for additional downhole or surface sensors. The rod position and load can be used to control the operation of the pump 110 to optimize the operation of the pump 110. In addition, American Petroleum Institute (API) specifications have been used to define the pump geometry that allows the use of readily available data from pump manufacturers. System identification routines are used to establish installation dependent parameters specific to the particular pump used in calculating performance parameters that are used in real-time closed loop control of the operation of the rod pump, obviating the need to create large look-up tables for parameter values used in calculating performance parameters.

The pump control system 104 includes transducers, such as current and voltage sensors, to sense dynamic variables associated with motor torque and velocity. Current sensors are coupled to a sufficient number of the motor leads for the type of motor used. The current sensors provide voltages proportional to the instantaneous stator currents in the motor 130. Voltage sensors are connected across to a sufficient number of the motor windings for the type of motor used and provide voltages proportional to the instantaneous voltages across the motor windings. The current and voltage signals produced by sensors are supplied to a processor 124 through suitable input/output devices. The processor 124 further includes a processing unit 126 and storage devices 128 which stores programs and data files used in calculating operating parameters and producing control signals for controlling the operation of the rod pump system 104. This control arrangement provides nearly instantaneous readings of motor velocity and torque which can be used for both monitoring and real-time, closed-loop control of the rod pump. For example, in one embodiment, computations of motor velocity and torque used for real-time, closed-loop control are provided at the rate of 1000 times per second.

Motor currents and voltages are sensed to determine the instantaneous electric power level drawn from the power source by the electric motor operating the well pump. As the rod string 144 that drives the downhole pump 110 is raised and lowered during each cycle, the motor 130 is cyclically loaded. Depending on the particular pump installation configuration, the walking beam 139 is at a known position during maximum and minimum motor loads. The timing of these maximums and minimums can define the operational pumping frequency and, by integration of the motor velocity in light of the motor to crank gearing, it is possible to estimate the phase position of the pump crank at any time. By monitoring the variances of the motor currents and voltages as a function of pump crank angle, the voltage and current variances can be used together with parameters related to pump geometry to calculate estimates of rod position and rod load.

The apparatus and method described herein applies to the control of traditional sucker rod "pump jacks" with "crank arm" counterbalance mechanism as shown in FIG. 1. The "crank balance" aspect refers to the rotary counterweight 142 mounted to the crank arm 134. In some configurations there may be two crank arms and counterweights.

Figure 10:
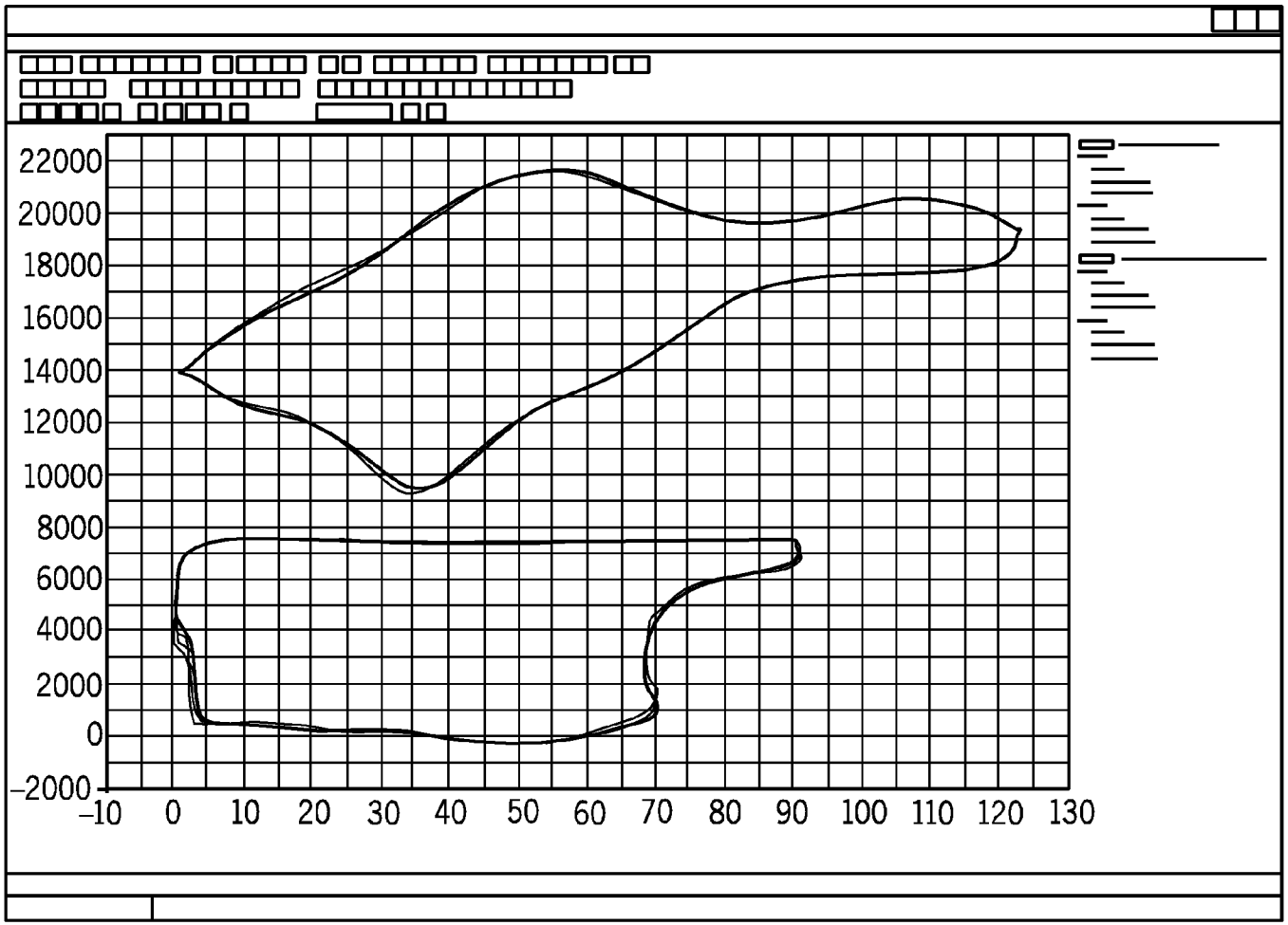
FIG. 10 is an exemplary chart of a dynamometer plot, generated by the method disclosed herein without external mounted sensors affixed to the pump system illustrated in FIG. 1, and used to control the pump system for optimal production operation.

This disclosure allows a sucker rod pump controller 124 to generate "dynamometer plots," as shown in FIG. 10, without the need for externally mounted sensors affixed to the pumping unit. The controller 124 can in turn use the dynamometer plots to automatically adjust some parameter of the pumping system such as prime-mover speed, torque, or power to improve or optimize the operation of the pumping system. For example, oil production may be increased, oil reservoir better managed to promote higher ultimate recovery, and/or pumping equipment life increased by elimination of sucker rod buckling and fluid pound, in turn reducing tubing wear and the associated maintenance costs and loss of downtime production losses.

Figure 6:
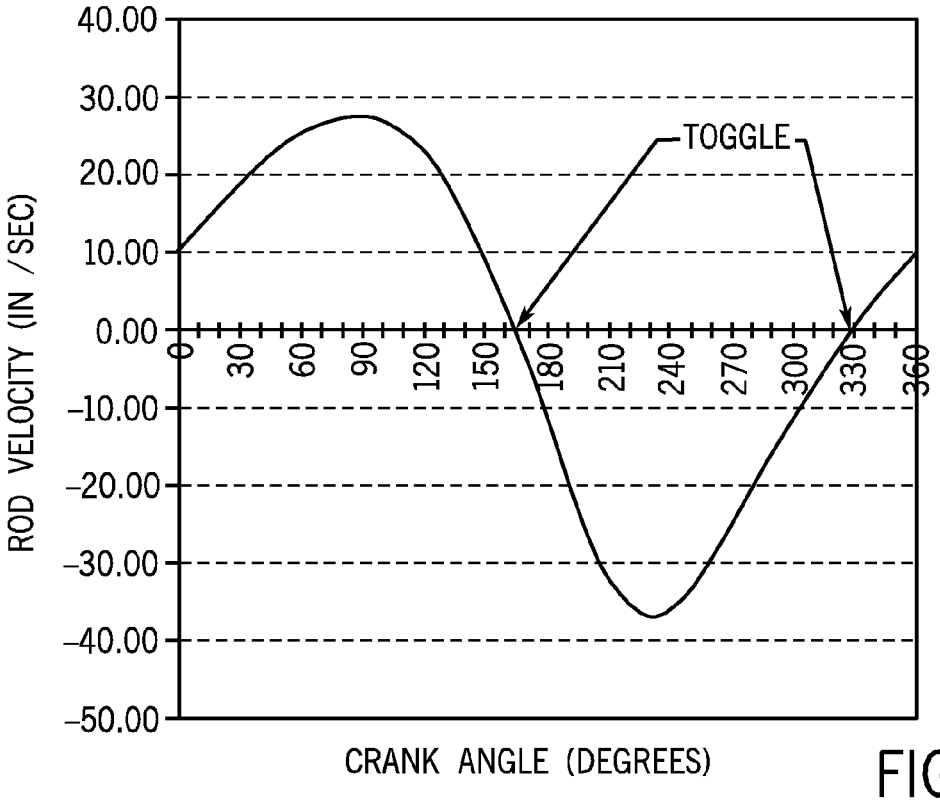
FIG. 6 is an exemplary chart of identification of toggle point when charting the rod velocity against the crank arm angle.
Figure 7:
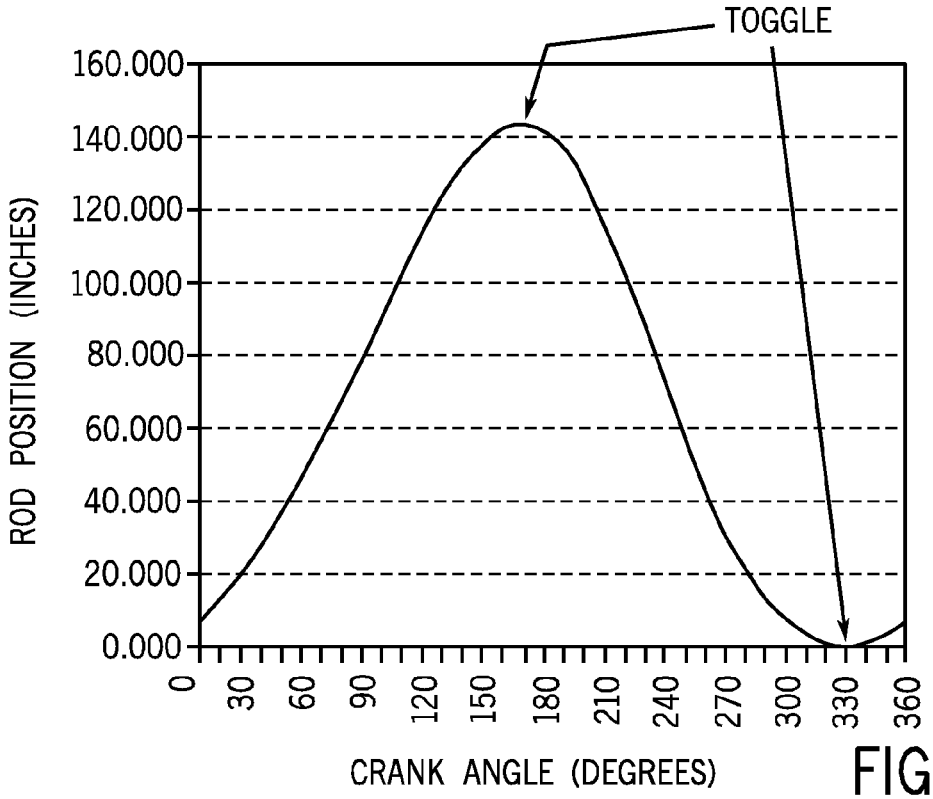
FIG. 7 is an exemplary chart of identification of toggle point when charting the rod position against the crank arm angle.

The controller 124 must generate a value representative of the pumping unit position, such as the angle of the crank arm 134. According to the disclosure, the angle of the crank arm can be periodically determined by analysis of the motor torque coupled with knowledge of the pumping unit geometry, specifically the pumping unit "toggle points." The toggle points are defined as "top dead center" and "bottom dead center" positions of the pumping unit 104 main beam 138, where the rod is at its maximum and minimum extended positions, as the "torque factor" (as known in the art) passes through zero. FIGS. 6 and 7 illustrate the toggle points. FIG. 6 is a chart illustrating the toggle points when charting rod velocity against crank angle. FIG. 7 is a chart illustrating the toggle points when charting the rod position against the crank angle.

The toggle points represent unique singularities during the polished rod 146 stroke, providing small "windows" which the controller 124 can use to identify the crank arm 134 position from the crank torque value. As the pumping unit passes through its toggle points, the crank torque (and therefore motor torque) is completely decoupled from complex effects of the rod load. At the toggle points, the motor torque is influenced solely by the effects of motor 130 and pumping unit rotary inertia, pumping unit counterweight effect, and rotary friction, all of which can be adequately estimated and therefore predicted or measured upon initial commissioning. Furthermore, these "windows" occur at regular intervals, and the relative distance between said intervals can be analytically predetermined given the geometry of the pumping unit.

During portions of the pumping unit cycle other than its toggle points, the motor torque is influenced by several confounding factors. If one were to attempt to determine the crank position (reference the pumping unit) based on analysis of the motor torque during any portion of the cycle other than the toggle points, the complexity of the aforementioned influences would render the technique untenable. As such, it is extremely difficult to correlate the motor torque to motor position at any point during the cycle other than the unit toggle points (where the expected torque is more highly predictable).

Expounding upon this point, following is a list of the various forces that contribute to the torque observed at the prime mover motor 130, comprising:

- Downhole pump liquid load (the weight of liquid column acting on the pump plunger)
- Rod weight (the weight of the sucker rods)
- Pumping unit counterbalance torque
- Pumping unit rotary inertia
- Pumping unit articulating inertia
- Friction (pump, fluid, rod, stuffing box, pumping unit, gearbox, etc.)

Figures 2, 3:
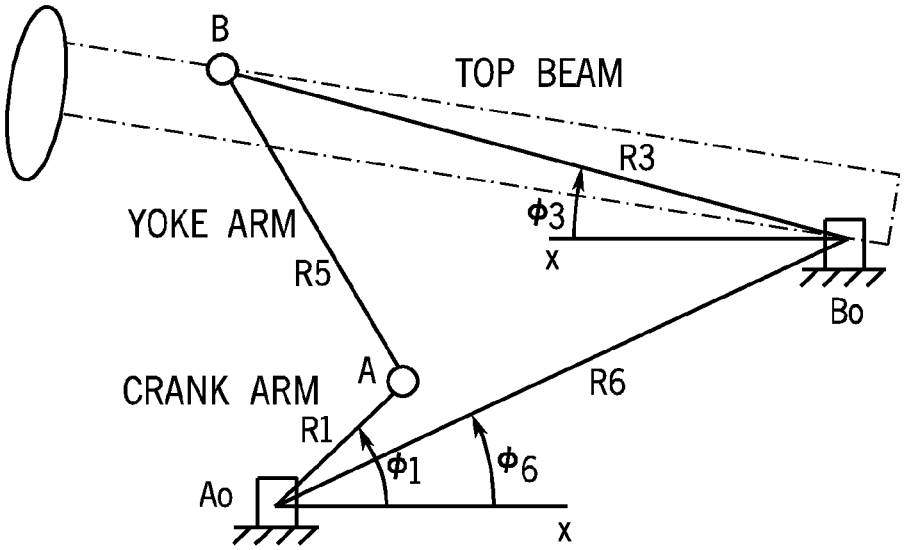
FIG. 2 is a schematic illustration of the pump system illustrated in FIG. 1 and identify several geometric relationships.
FIG. 3 is an equation, using the geometric relationship identified in FIG. 2, to determine, in the controller computer illustrated in FIG. 1, a crank arm angle where a maximum and minimum position of pumping system main beam, corresponding to a toggle point of a crank arm position at an up-stroke and down-stroke position of the main beam.

The various forces listed above are translated back to the motor 130, as a torque, through the geometry of the pumping unit. The geometry of the pumping unit mechanism (See FIG. 2) affects the magnitude of these forces as a function of the position of the pumping unit mechanism, specifically the relationship of the main beam 138 angles to the crank arm 134 as determined by the equation in FIG. 3, resulting in a composite motor torque signature that is difficult to decipher, specifically difficult to correlate to a particular position. Sucker rod dynamic forces and complex pumping unit geometries further confound the motor torque signature.

The load torque observed at the motor 130 is also affected by the following variable influences:

- Fluid level
- Pump fill
- Pumping speed
- Control mode (speed profiling, dual speed, rod load control, etc.)
- Fluid gas content
- Other The highly variable load torque resulting from the rod 146, pump 110, fluid, dynamics, etc. are decoupled from the motor 130 at the two mechanism toggle points, making interpretation of the torque at those points possible, ultimately allowing the crank arm 134 position to be identified. Three torque effects persist at the toggle points, however, which must be identified. Said torque effects include: rotary inertia effects, gearbox friction, and some counterweight effect. The counterweight torque effect (at the toggle points) results from an asynchronous relation between the rotary counterweight (which behaves as a sinusoidal torque) and the pumping unit crank "torque factor" (which behaves as a distorted sinusoid). The distortion in the crank "torque factor" is caused by the pumping unit crank pivot being offset from pitman arm 136 pivot, as well as the pivoting motion of the main beam 138, both of which create an asymmetry between the crank arm 134 and the counterweight effect. The pumping unit behaves like a "four bar linkage," (See FIG. 2) whereas the counterweight behaves like a pure sinusoid. These differences in behavior create a slight asymmetry in the toggle points, as well as what is referred to as a counterweight "phase angle" in the art. Consequently, the two mechanism toggle points do not occur at exactly 0 and 180 degrees of the crank, nor are they exactly 180 degrees apart, resulting in some rotary counterbalance moment at the toggle points (given that the rotary counterweights exert a purely sinusoidal torque as they rotate about the crank arm). The invention takes advantage of the difference between the symmetrical, sinusoidal counterweight versus the unsymmetrical nature of the toggle point in the mechanism-it allows the toggle points to be identified.

At the toggle points, the load observed by the motor 130 is comprised solely of rotary inertia, counterbalance moment, and rotary friction. The counterbalance moment at each toggle point is typically a different, unique value. The toggle points are asymmetrical, and therefore identifiable. The invention algorithm takes advantage of the fact that the counterbalance moment is a unique value at each toggle point, and that the toggle points are asymmetrical and a known distance apart. This disclosure utilizes the fact that the rotary inertia effects can be either calculated (since they are predictable) or can be automatically identified in the aforementioned established Well ID routine disclosed in the U.S. Pat. No. 7,168,924 to characterize the pumping unit system. This disclosure configures the controller to identify the unique torque signature associated with the toggle points, thereby allowing the crank arm 134 position to be identified during the normal (also referred to as production pumping) operation of the pumping system 104.

To identify the aforementioned unique torque signature, the controller 124 must first decouple the effects of the rotary inertia and rotary friction from the crank torque (crank torque is motor torque times gear ratio times gearbox efficiency). The resulting value is referred to as the "rxless torque," and comprises only load torque and counterbalance torque. Rotary inertia and rotary frictional effects have been decoupled. Were these influences not decoupled, the toggle torque levels would be subject to changes in pumping speed. With the effects decoupled, the rxless toggle torque levels are insensitive to speed changes, allowing the system 104 to function over various speeds.

During the initial commissioning of the pumping system, the preferred embodiment of the invention uses an identification routine to store the "rxless torque" value at each the toggle points. An inclinometer (or other position reference device) is affixed to the pumping unit at the time. The toggle point positions of the crank are pre-calculated based upon the geometry of the pumping unit. As such, the system can "learn" the rxless torque levels at the toggle points (while the pumping unit is running in a calibration mode). In addition, the preferred embodiment of the disclosure also latches (stores) the derivative of the rxless torque, providing yet another characteristic of each toggle point (whether increasing or decreasing rxless monitor as the crank passes through the toggle point). This additional characteristic (known as RISE or FALL "rule") will narrow the potential for an erroneous match during normal (production) operation of the system, making it more robust (See FIG. 9). The initial commissioning is then complete, and the temporary inclinometer can be removed.

Subsequently, during the normal (production) operation of the pump 110, the "rxless torque" is continuously sampled, along with the crank arm 134 relative position. The system compares the rxless torque value to the "learned" (stored) rxless torque value data (latched during commissioning) for the best match, looking for two values of rxless torque that equal the known latched rxless values (at the toggle points) spaced by the known crank arm 134 distance between toggle points, and also obeying the RISE or FALL rule of the derivative of rxless torque. When a match is found, relative crank position can subsequently be referenced (corrected) to the position associated with the match, thus absolutely referencing the crank arm 134 position. This part can be thought of as pattern recognition. The crank reference is now complete, and the system will be capable of drawing dynamometer plots and controlling the pumping system in production pumping accordingly in conjunction with the system disclosed in U.S. Pat. No. 7,168,924.

Figure 4:
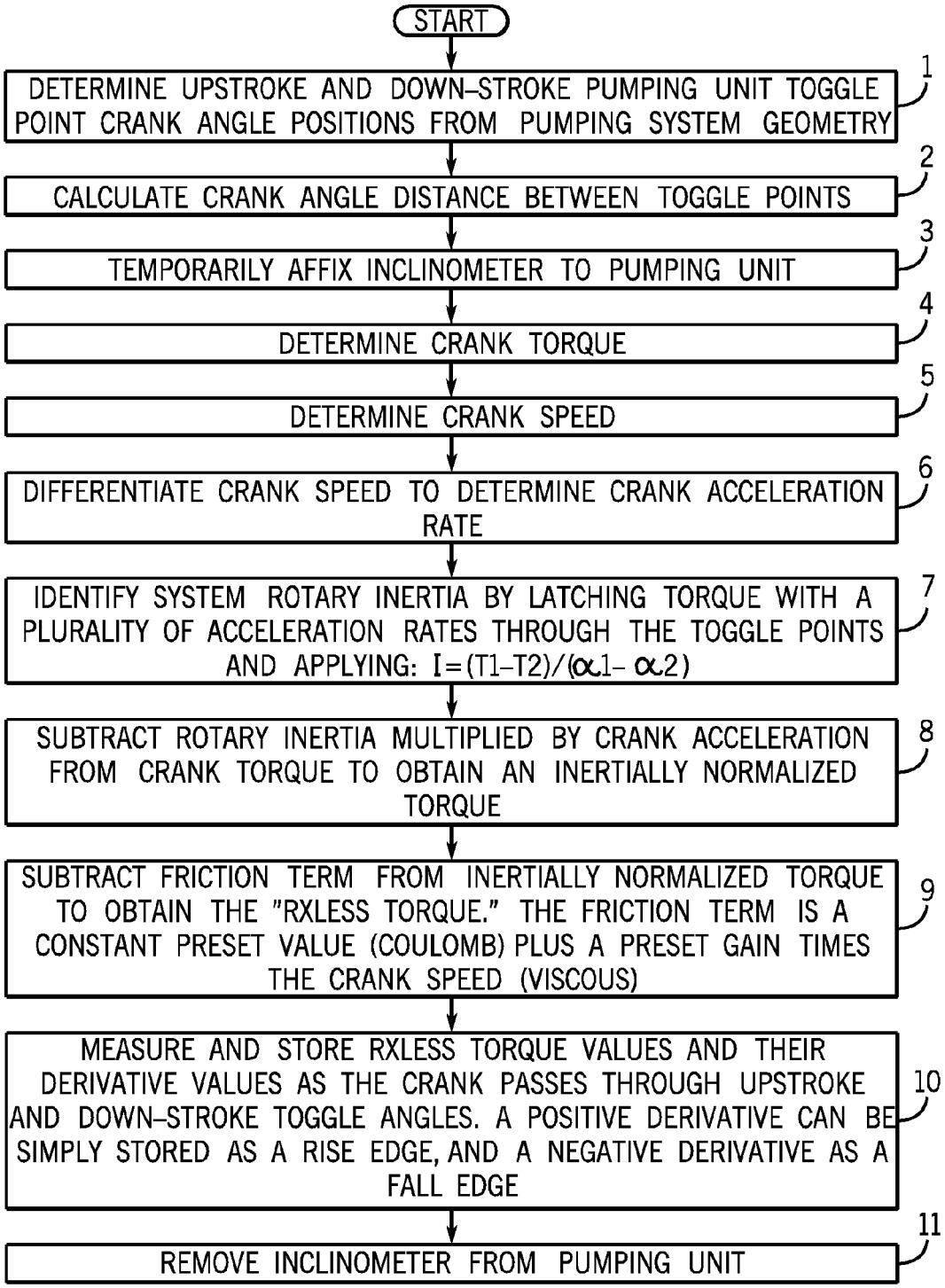
FIG. 4 is a flow chart of an initial commissioning process for the pumping system in accord with this disclosure.

FIG. 4 is a flow chart representative of the initial commissioning process. Each step is executed by the computer 126 in the controller 124.

1. The upstroke and down-stroke pumping unit toggle point crank angle positions are determined from the pumping unit geometry, illustrated in FIG. 2. This is accomplished in the controller's computer by processing the equation in FIG. 3 to find the Crank Arm angles where the Top Beam angle is both maximized and minimized, corresponding to the upstroke and down-stroke toggle point crank angle positions, respectively.
2. The crank angle distance between the toggle point positions identified in Step 1 is computed.
3. A temporary inclinometer device is affixed to the top beam of the pumping unit.
4. The crank torque is determined from motor torque per U.S. Pat. No. 7,168,924. Crank torque is equal to motor torque divided by the gear ratio between the motor and crank.
5. While the pumping unit is running, the crank speed is derived from motor speed as described in U.S. Pat. No.

7,168,924. Crank speed is equal to motor speed divided by the gear ratio between the motor and crank.

6. The crank acceleration is determined by differentiating the crank velocity.
7. The controller identifies the total rotary inertia (at the crank) by accelerating the pumping unit crank through one of the mechanism toggle points at two different acceleration rates while latching (storing) the resulting crank torque values precisely as the mechanism passes through the toggle point. The rotary inertia can subsequently be solved for by applying the following equation:

$$\text{rotary inertia}=(\text{torque1}-\text{torque2})/(\text{accel rate1}-\text{accel rate2})$$

Figure 8:
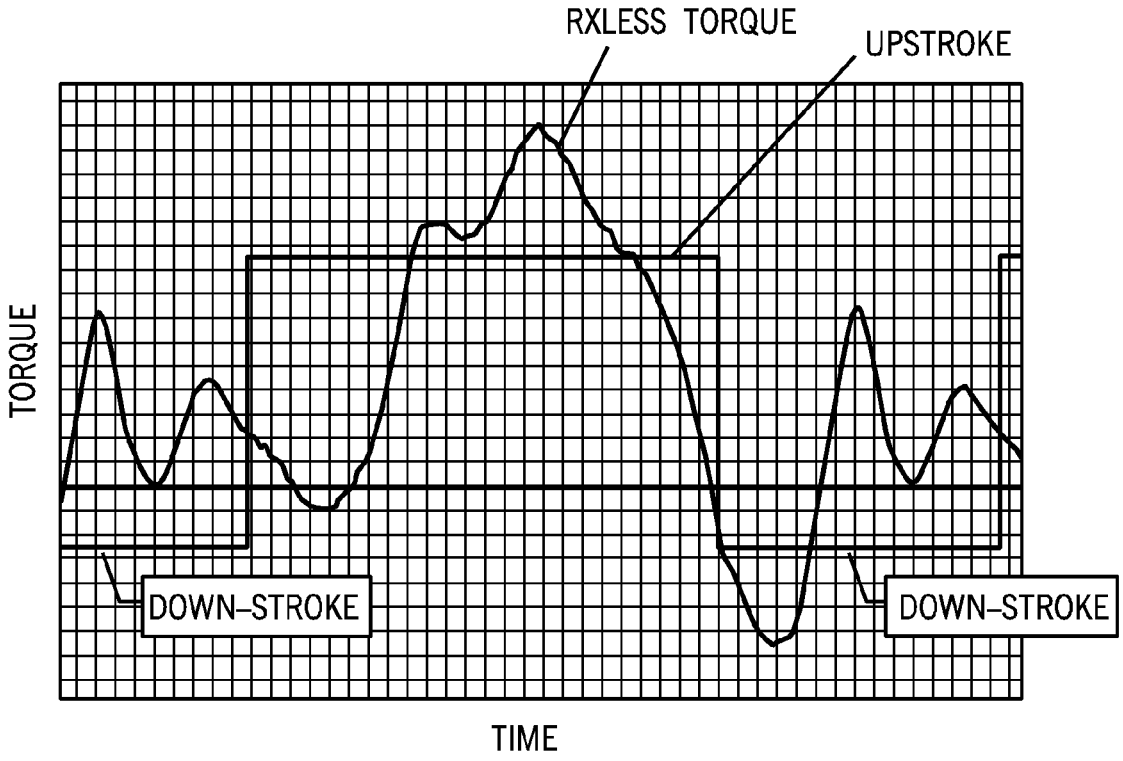
FIG. 8 is an exemplary chart identifying a rxless torque value during an upstroke and downstroke of the pump system main beam during production pumping.

8. A normalized torque value is derived by subtracting the rotary inertia multiplied by the crank torque.
9. The "rxless torque" value is generated by subtracting a friction term from inertially normalized torque. The friction term is a constant preset value (coulomb friction) plus a preset gain times the crank speed (viscous friction). An example rxless torque signal is shown in FIG. 8 along with a trace illustrating upstroke versus down-stroke status. The x and y coordinate units are not pertinent.
10. The crank angle is monitored as described in U.S. Pat. No. 7,168,924, and the rxless torque value is latched and stored at the precise instant the crank angle passes through the toggle angles calculated in step 1, thus resulting in the stored upstroke and down-stroke toggle point torque values.
11. The temporary inclinometer is removed from pumping unit inasmuch as it is no longer required. Initial commissioning is complete.

Figure 5:
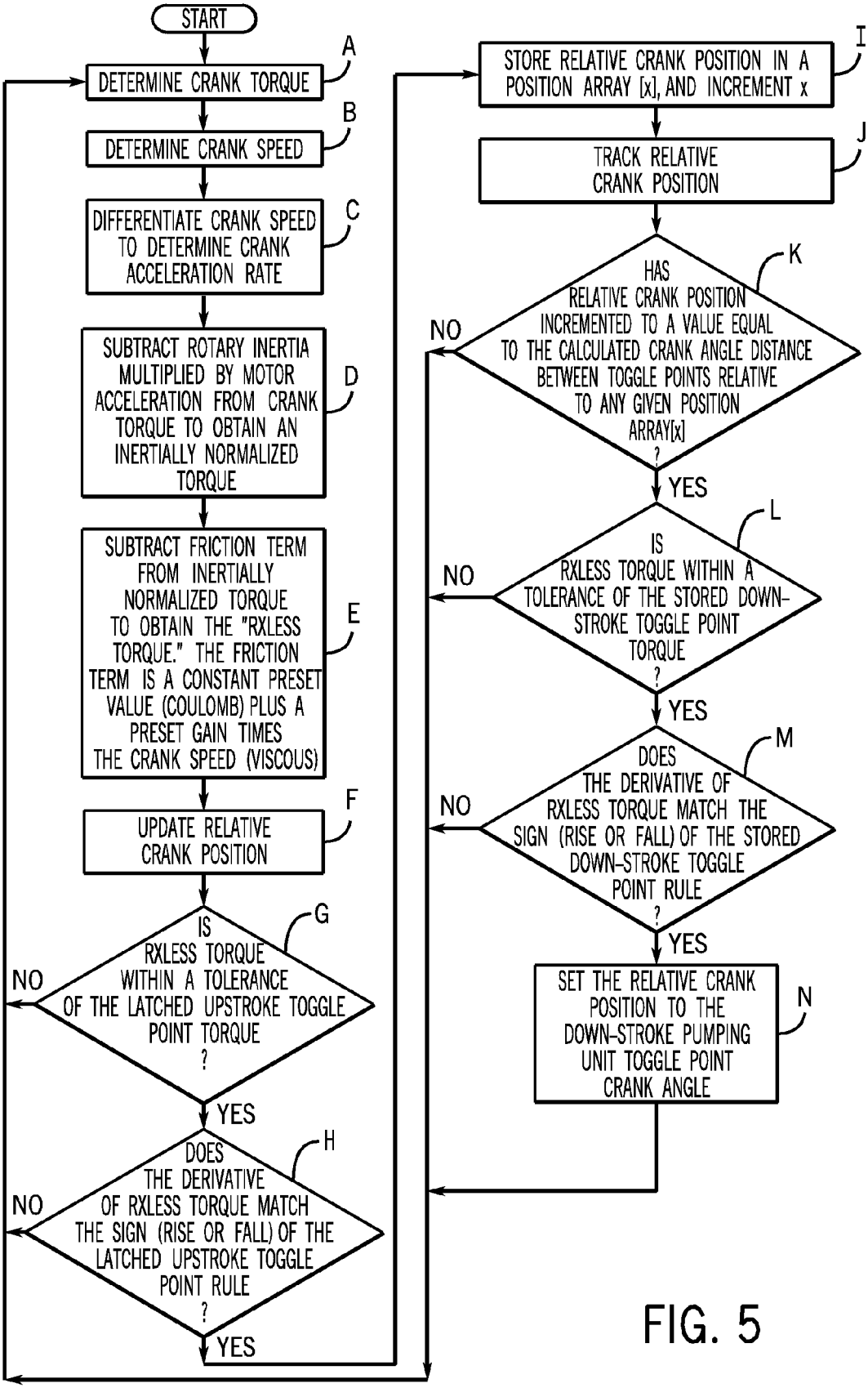
FIG. 5 is a flow chart of a production pumping (normal) mode of the sucker rod pump system illustrated in FIG. 1, without a crank arm position sensor.

FIG. 5 is a flow chart representative of the normal operation mode (production pumping) of the pumping system (as the pumping system produces fluids to the surface during its normal operation). Each step is executed in the computer 126 in the controller 124.

A. The crank torque value is determined from motor torque per U.S. Pat. No. 7,168,924.
B. The crank speed is derived from motor speed as described in U.S. Pat. No. 7,168,924. Crank speed is equal to motor speed divided by the gear ratio between the motor and crank. The gear ratio is determined by the user.
C. The crank acceleration is determined by differentiating the crank velocity.
D. A normalized torque signal is derived by subtracting the rotary inertia multiplied by the crank torque.
E. The "rxless torque" signal is generated by subtracting a friction term from inertially normalized torque. The friction term is a constant preset value (coulomb friction) plus a preset gain times the crank speed (viscous friction). An example rxless torque value is shown in FIG. 8 along with a trace illustrating upstroke versus down-stroke status. The x and y coordinate units are not pertinent.
F. The relative crank position is determined from motor position per U.S. Pat. No. 7,168,924. The relative crank position represents the position of the crank, but its absolute position is unknown. Consequently, as the crank rotates, the relative crank position follows, but is offset from, the actual crank position. The offset is unknown at this time.
G. The rxless torque value is monitored as the pumping unit is operating. If the rxless torque value is within a tolerance of the stored (latched) upstroke toggle point torque, then continue:
H. If the sign of the derivative of the same rxless signal matches the sign of the stored upstroke toggle point rule (RISE or FALL) (see FIG. 9), then it is possible that the position corresponding to this point represents the upstroke toggle point (candidate toggle position), and therefore continue:
I. Store the current relative crank position in an array [x], and increment x. As such, the controller can store and track several candidate toggle positions.
J. Track the relative crank position.
K. Check to see if the relative crank position has incremented to a value equal to the calculated crank angle distance between toggle points for every stored crank position [x]. If so, continue:
L. The rxless torque value is monitored. If the rxless torque value is within a tolerance of the stored (latched) down-stroke toggle point torque, then continue:
M. If the sign of the derivative of the same rxless value matches the sign of the stored upstroke toggle point rule (RISE or FALL), then the position corresponding to this point represents the down-stroke toggle point, and therefore the absolute position of the crank has been identified. Continue:
N. Set the relative crank position estimate to the down-stroke toggle point crank angle. The crank position is now absolutely referenced. Return to step A and re-reference the absolute crank position with each pumping unit stroke (since the position can drift).

Figure 9:
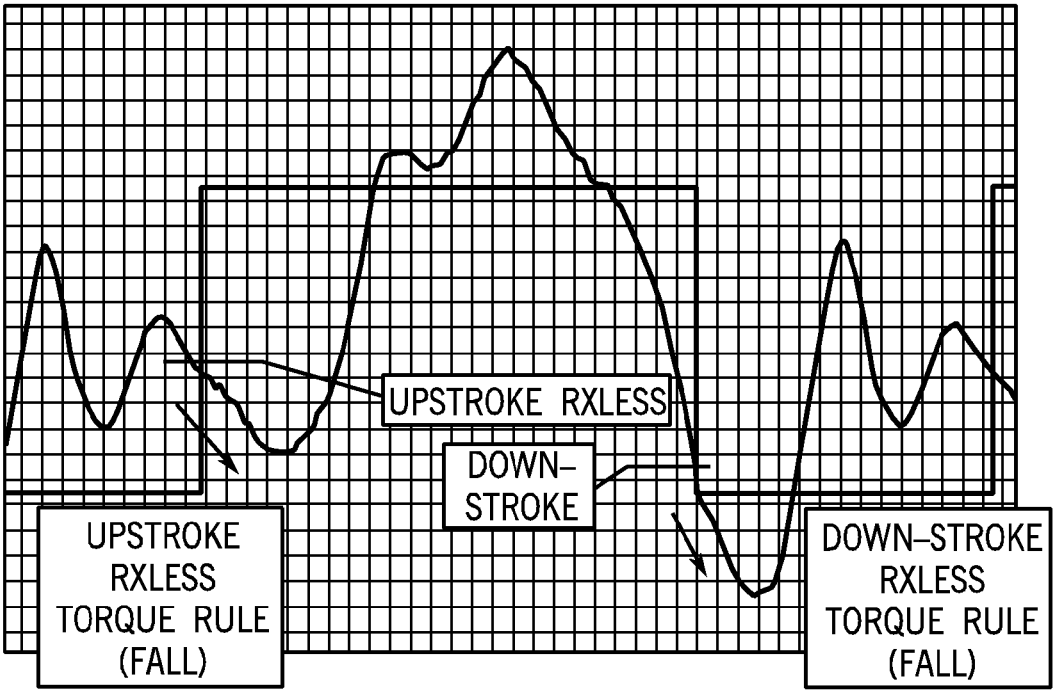
FIG. 9 is an exemplary chart illustrating an rxless torque value and the FALL Rule that correspond to absolute crank arm position determined by the method disclosed herein.

FIG. 9 shows how the rxless torque value levels and RISE or FALL rules correspond to the absolute crank position, illustrating how the method can function. The state changes of the Pump Direction signal (labeled Upstroke and Down-stroke) occur at the toggle points of the pumping unit mechanism. The controller recognizes the two levels at the toggle points spaced the correct crank angle distance apart and obeying the Rules (RISE or FALL). When the pattern is recognized, the toggle point is identified and the controller references the crank position.

For purposes of this disclosure, the term "coupled" means the joining of two components (electrical or mechanical) directly or indirectly to one another. Such joining may be stationary in nature or moveable in nature. Such joining may be achieved with the two components (electrical or mechanical) and any additional intermediate members being integrally formed as a single unitary body with one another or the two components and any additional member being attached to one another. Such adjoining may be permanent in nature or alternatively be removable or releasable in nature.

Although the foregoing description of the present mechanism has been shown and described with reference to particular embodiments and applications thereof, it has been presented for purposes of illustration and description and is not intended to be exhaustive or to limit the disclosure to the particular embodiments and applications disclosed. It will be apparent to those having ordinary skill in the art that a number of changes, modifications, variations, or alterations to the mechanism as described herein may be made, none of which depart from the spirit or scope of the present disclosure. The particular embodiments and applications were chosen and described to provide the best illustration of the principles of the mechanism and its practical application to thereby enable one of ordinary skill in the art to utilize the disclosure in various embodiments and with various modifications as are suited to the particular use contemplated. All such changes, modifications, variations, and alterations should therefore be seen as being within the scope of the present disclosure as determined by the appended claims when interpreted in accordance with the breadth to which they are fairly, legally, and equitably entitled.

What is claimed is:

1. A method to determine position of a sucker rod pumping system without a position sensing device during production pumping, the pumping system including a rod string carrying a down hole pump, a variable drive coupled to the rod string for reciprocation of the rod string within a wellbore and for operating the pump, and a crank arm with a counterweight coupled to a main beam with a pitman arm and motor, with the motor being coupled to a controller, the method comprising:

performing an initial commissioning procedure to determine a rxless torque signal at toggle points of the crank arm during an initial non-production pumping cycle;

measuring the rxless torque signal;

storing the rxless torque signal in a database coupled to the controller;

continuously sampling the rxless torque;

determining crank arm position in relation to the sampled rxless torque;

comparing, with the controller, the sampled rxless torque to the stored rxless torque signal;

determining two of the sampled rxless torque signals that correspond to the stored rxless torque signals spaced by the crank arm toggle points; and adjusting, with the controller, the pumping system for optimal operation of the pumping system without a crank arm position sensor during production pumping by identifying a toggle point and setting a crank arm position estimate equal to the value corresponding to the crank position at that toggle point.

2. The method to determine position of a sucker rod pumping system without a position sensing device during production pumping of claim 1, further comprising: defining a toggle point as one of a top dead center and bottom dead center position of the main beam when the rod string is at, respectively, a maximum and minimum extended position.

3. The method to determine position of a sucker rod pumping system without a position sensing device during production pumping of claim 2, wherein a relationship between the crank arm counterweight and a pitman arm pivot is asymmetric.

4. The method to determine position of a sucker rod pumping system without a position sensing device during production pumping of claim 2, wherein the toggle point is one of a down stroke and an up stroke.

5. The method to determine position of a sucker rod pumping system without a position sensing device during production pumping of claim 1, further comprising: determining a rxless torque derivative and storing the derivative in the database, with a rxless torque derivative associated with each toggle point.

6. A pump control system for controlling the performance of a sucker rod pumping system during production pumping of a well, the sucker rod pumping system including a rod string carrying a down hole pump, a variable drive coupled to the rod string for reciprocation of the rod string within a wellbore and for operating the pump, and a crank arm, with a counterweight, coupled to a main beam with a pitman arm, the pump control system comprising:

a controller coupled to a database, with the controller configured to access a stored rxless torque in the database, with the stored rxless torque representative of toggle points of the crank arm during an initial calibration pumping cycle, the controller further configured to continuously sample the rxless torque of the system and determine a crank arm position in relation to the sampled rxless torque; and a motor coupled to the pitman arm and crank arm, with the performance of the motor controlled by the controller based on a comparison by the controller of the sampled rxless torque value to the stored rxless torque value, an identification of two of the sampled rxless torque values that correspond to the stored rxless torque value spaced by the crank arm toggle points, and an adjustment of a motor position estimate by the controller to set the crank arm position to a toggle point for optimal operation of the pumping system without a crank arm position sensor during production pumping.

7. The pump control system for controlling the performance of a sucker rod pumping system during production pumping of a well of claim 6, further comprising configuring the controller to define a toggle point as one of a top dead center and bottom dead center position of the main beam when the rod string is at, respectively, a maximum and minimum extended position.

8. The pump control system for controlling the performance of a sucker rod pumping system during production pumping of a well of claim 7, wherein a relationship between the crank arm counterweight and a pitman arm pivot is asymmetric.

9. The pump control system for controlling the performance of a sucker rod pumping system during production pumping of a well of claim 7, wherein the toggle point is one of a down stroke and an up stroke.

10. The pump system for controlling the performance of a sucker rod pumping system during production pumping of a well of claim 6, further comprising the controller configured to determine an rxless torque derivative and storing the derivative in the database, with an rxless torque derivative associated with each toggle point.

* * * * *